US010190590B2

(12) United States Patent
Volmer et al.

(10) Patent No.: US 10,190,590 B2
(45) Date of Patent: Jan. 29, 2019

(54) BATTERY-OPERATED BLOWER FILTER SYSTEM FOR USE IN POTENTIALLY EXPLOSIVE AREAS

(71) Applicant: Dräger Safety AG & Co. KGaA, Lübeck (DE)

(72) Inventors: Achim Volmer, Lübeck (DE); Björn Ehler, Lübeck (DE); Mathias Dehmke, Lübeck (DE); Andreas Sürig, Krummesse (DE)

(73) Assignee: Dräger Safety AG & Co, KGaA, Lübeck (DE)

( * ) Notice: Subject to any disclaimer, the term of this patent is extended or adjusted under 35 U.S.C. 154(b) by 314 days.

(21) Appl. No.: 14/413,766

(22) PCT Filed: Jul. 5, 2013

(86) PCT No.: PCT/EP2013/001989

§ 371 (c)(1),
(2) Date: Jan. 9, 2015

(87) PCT Pub. No.: WO2014/008998

PCT Pub. Date: Jan. 16, 2014

(65) Prior Publication Data

US 2015/0211534 A1 Jul. 30, 2015

(30) Foreign Application Priority Data

Jul. 10, 2012 (DE) ..... 10 2012 013 656

(51) Int. Cl.
*F04D 25/06* (2006.01)
*A62B 17/00* (2006.01)
(Continued)

(52) U.S. Cl.
CPC ..... *F04D 25/0673* (2013.01); *A62B 17/006* (2013.01); *A62B 18/006* (2013.01); *F04D 27/001* (2013.01); *F04D 27/008* (2013.01)

(58) Field of Classification Search
CPC ..... A62B 17/006
See application file for complete search history.

(56) References Cited

U.S. PATENT DOCUMENTS 5,947,691 A * 9/1999 Brown ..... H02K 11/25 417/44.1
2007/0119452 A1* 5/2007 Schubert ..... A62B 7/10 128/204.21
2008/0238370 A1* 10/2008 Carrier ..... H01M 2/1022 320/134

FOREIGN PATENT DOCUMENTS

CN 2012 59868 Y 6/2009
CN 102368628 A 3/2012
(Continued)

*Primary Examiner* — Kenneth J Hansen
(74) *Attorney, Agent, or Firm* — McGlew and Tuttle, P.C.

(57) ABSTRACT

A blower filter system includes a blower unit (11), an electric motor (24) for driving a blower impeller, a control unit (27) for controlling the electric motor, contacts (22, 23) for connecting to a battery pack, and a battery pack (10) with secondary cells (12) with high energy density and contacts (22, 23) for connecting to the blower unit. The blower unit (11) can be detachably coupled to the battery pack (10). The battery pack is electrically connected to the blower unit via the contacts. The battery pack (10) has protective circuits including electronic components (15, 16, 17, 18, 19, 20, 21, 31) to electrically switch off at least one of the plurality of secondary cells (12) of the battery pack if excessive currents and/or excessive temperatures occur. The battery pack (10) and the blower unit (11) are each at least partially cast in a casting compound.

20 Claims, 3 Drawing Sheets

(51) Int. Cl.
*A62B 18/00* (2006.01)
*F04D 27/00* (2006.01)

(56) References Cited

FOREIGN PATENT DOCUMENTS

| | | | |
|---|---|---|---|
| DE | 28 08 963 | A1 | 9/1979 |
| DE | 103 07 330 | A1 | 9/2004 |
| EP | 0 334 098 | A1 | 9/1989 |

* cited by examiner

BATTERY-OPERATED BLOWER FILTER SYSTEM FOR USE IN POTENTIALLY EXPLOSIVE AREAS

CROSS REFERENCE TO RELATED APPLICATIONS

This application is a United States National Phase Application of International Application PCT/EP2013/001989 filed Jul. 5, 2013 and claims the benefit of priority under 35 U.S.C. § 119 of German Patent Application DE 10 2012 013 656.0 filed Jul. 10, 2012, the entire contents of which are incorporated herein by reference.

FIELD OF THE INVENTION

The present invention pertains generally to a respirator system and specifically to a blower filter system or a battery-operated blower filter system, which comprises an electrically operated blower unit and a battery pack that can be coupled therewith. The present invention pertains, in particular, to a battery-operated blower filter system for use in potentially explosive areas.

BACKGROUND OF THE INVENTION

In respirator systems, distinction is made, in principle, between ambient air-independent and ambient air-dependent respirator systems. If the user is in an atmosphere with low oxygen concentration, the breathing air needed must be supplied continuously from a compressed air cylinder via a compressed air hose. If, by contrast, the surrounding atmosphere contains a sufficient quantity of oxygen, a lightweight, ambient air-dependent breathing system can be used, which is equipped with a special filter, which is adapted to the particular harmful substances present in the atmosphere to and the concentrations of these substances. The filters of such a system are usually mounted on a breathing mask or face mask via a screw thread, and this filter is designed to filter harmful dusts, gases or vapors, aerosols, etc., from the ambient air. However, it is also possible to use, as an alternative, filters that are provided separately from the mask and are connected with the mask via a breathing tube. These separate filters may be carried, for example, on the user's belt. The filters used differ from each other in terms of their fields of use, but they have basically the property of removing gases and vapors by absorbing them on sorbents (e.g., impregnated activated carbon) or particles and aerosols, for example, by a microfiber filter.

Ambient air-dependent respirator systems, which are provided or coupled with a filter (also called "Air-Purifying Respirator"=APR), are usually small, lightweight and easy to use. One drawback of these systems is, however, the fact that the user's breathing resistance and hence the user's breathing work is increased by the filter, as a result of which the performance of the user in action is compromised in an undesired manner. To overcome this drawback, filter-type breathing systems were developed, which are provided with a blower unit, and which are also called blower-assisted respirator systems or blower filter systems (Powered Air-Purifying Respirator=PAPR) and by means of which the user's breathing work is markedly reduced. These systems comprise essentially a breathing mask (or face mask or hood), which is provided with a breathing port (mostly a round threaded port) for connecting a breathing tube, and a blower unit, which contains a blower device, an energy supply unit and a filter insert for coupling a suitable filter. The blower unit (or blower system device) is preferably carried on the user's belt. Contaminated air is drawn in from the surrounding area in such a system by means of the blower unit, filtered by means of the coupled filter, as a result of which the contaminated air is freed from harmful substances, and blown through the breathing tube into the face mask.

The above-described blower filter systems are used, in general, for light and medium breathing protection. The advantage of these blower filter systems is that they support the user during breathing by lowering the breathing protection compared to conventional breathing masks and thus make long-term as well as fatigue-free use possible. However, these blower filter systems have some drawbacks. Thus, the user must carry not only the breathing mask but additionally also the blower filter system attached to the belt (blower unit). The entire system is thus relatively heavy and possibly unwieldy, which may affect the user's freedom of movement. This drawback is especially manifest when the system is designed for long operating times, and the blower filter system attached to the belt must therefor be equipped with a large number of batteries (secondary cells) and therefore becomes large, heavy and unwieldy.

The blower filter system contains, among other things, a blower impeller driven by an electric motor and a blower housing (e.g., a spiral housing) adapted to the blower impeller. The energy for this blower unit (i.e., for the electric motor and the corresponding central control unit) is provided by an energy supply unit, which preferably has rechargeable batteries (batteries or secondary cells). The motor of the blower unit is controlled by means of the central control unit. The control unit is further designed to process, for example, data input by the user. These input data comprised, for example, the switching on and off of the blower unit or the setting of the output of the blower unit. In addition, the control unit may be designed to adapt the output of the motor (or of the blower unit) to the user's requirements. This is especially important when the user needs more breathing or because of increased physical stress or when the breathing resistance through the filter increases after a prolonged operating time. The blower unit, control unit and energy supply unit are usually enclosed by a housing. At least one filter may be connected to this housing. As an alternative, the filter may, however, also be arranged within the housing. In addition, the breathing tube may be connected with one end to this housing, in which case the other end of the breathing tube is coupled with the breathing mask. Air is drawn into the housing of the blower unit by means of the blower device during the operation and is then sent to the face mask through the breathing tube connected to the blower unit. The face mask is provided with an exhalation valve for breathing out the consumed breathing air.

As was explained above, blower filter systems are used under greatly different ambient conditions. These may comprise ambient conditions under which the surrounding atmosphere contains potentially explosive gases or dusts. Special requirements are imposed on the components used in the blower filter systems in this case. Two reasons for a potential ignition must be ruled out in case of explosion protection: (1) Spark ignition, which may be induced by an energy released in case of a defect, must be avoided, and (2) self-ignition, which may be induced by overheating of components of the blower filter system, must be ruled out.

Blower filter devices or blower filter systems for use in potentially explosive areas are already known. However, battery packs (=energy supply unit), which contain nickel-metal hydride or nickel-cadmium cells, are used in these prior-art devices. To reach adequate operation times, a large number of cells must be connected together, as a result of which the weight of the device to be carried by the user increases markedly.

SUMMARY OF THE INVENTION

A basic object of the present invention is therefore to provide a blower filter system and especially a battery-operated blower filter system, which is set up especially for use in potentially explosive environments. It is the object of the present invention, furthermore, to provide a blower filter system by means of which the above-mentioned drawbacks of prior-art respirator systems are overcome.

According to the invention, a blower filter system is provided comprising a blower unit, a battery pack detachably coupleable with the blower unit and casting compound. The battery pack and the blower unit are cast at least partially in the casting compound. The blower unit comprises a blower impeller electric motor, a control unit controlling the electric motor and blower unit contacts. The battery pack comprises a plurality of high energy density battery cells, battery pack contacts for connection with the blower unit contacts to provide an electrical connection of the battery pack with the blower unit via the battery pack contacts and the blower unit contacts and protective circuits. The protective circuits comprise electronic components to electrically cut off at least one of the plurality of the high energy density battery cells upon at lest one of a build up of current and a build up of temperature.

A blower filter system according to the invention is used to accomplish these and further objects. Advantageous and preferred variants of the blower filter system according to the present invention are described herein. It should be mentioned that the blower filter system according to the present invention is described in this specification generally as a respirator system, equipped with a blower system, which is especially suitable for use in potentially explosive environments. However, the inventive idea on which the blower filter system is based may also be used in other respirators or breathing systems.

To accomplish the above objects, a blower filter system with a blower unit is provided, whose blower motor (electric motor) is supplied by an energy supply unit (battery pack), which contains batteries or secondary cells with a markedly higher energy density than the nickel-metal hydride or nickel-cadmium cells used hitherto. The operating time of the blower filter system according to the present invention can be markedly prolonged hereby due to a larger number of cells being able to be used than before without the weight and/or size of the blower filter system being increased. As an alternative, the size and/or weight of the blower filter system can be reduced while maintaining the current operation time. Lithium ion cells (Li ion batteries) or lithium-manganese cells (LiMn batteries) are preferably used as secondary cells with higher energy density.

Classical nickel-metal hydride cells (NiMH cells) usually have an energy density of 55-113 Wh/kg, whereas lithium ion cells have an energy density of 150-200 Wh/kg and lithium-manganese cells have an energy density of 200-270 Wh/kg.

In a preferred exemplary embodiment, lithium-nickel-cobalt-aluminum-based cells ($LiNiCoAlO_2$) with carbon as a stabilizer are used, which have an energy density of up to 270 Wh/kg. This means that the energy supply unit of the blower unit can be implemented with less than half the weight and with a markedly reduced size at equal operation time.

Another advantage of lithium-based cells is that, contrary to NiMH or NiCd cells, they have no "memory effect," as a consequence of which the usable capacity of the lithium cells changes only insignificantly at best even after a large number of charge cycles.

As was explained above, the blower filter system according to the present invention is especially suitable for use in potentially explosive or explosive environments. To protect this potentially explosive environment from a possible ignition because of gases or dusts present in the atmosphere, the maximum energy occurring and/or maximum energy peaks, which may occur especially in case of defect (i.e., defect of one or more cells, defect of the control unit or defect of the blower motor) must therefore be limited. In addition, the surface temperature of the secondary cells or of the battery pack must be maintained below an ignition point or temperature limit.

To maintain the surface temperature of the battery pack below a certain temperature limit, the cells are preferably cast in a material that possesses good heat conduction properties. A great increase in temperature of an individual cell, which occurs due to a defect, can be eliminated and uniformly distributed in this manner. The other electronic components of the battery pack or of the energy supply unit are preferably also cast in the casting compound in order to prevent electric sparks and arcs from developing and to eliminate elevated temperatures of these components. Consequently, the casting compound also must possess good electrically insulating properties.

According to the present invention, a possible short circuit current of the battery pack is limited by an active redundant current limitation such that the energy released in case of defect is maintained below a certain limit. The ignition of explosive gases or dusts, which are contained in the ambient atmosphere, is effectively prevented in this manner.

Due to their high energy density, Li ion cells have a high self-heating potential. As was noted above, this problem can be reduced by casting the cells of the battery pack in a material possessing good heat conduction properties. In addition, devices for removing excess heat are provided, for example, in the form of cooling plates and/or cooling ribs. It is likewise possible that the excess heat is removed by devices for heat transfer or heat dissipation to the housing of the blower unit. For example, heat-conducting plates and/or heat-conducting pastes may be used for this. The blower unit and/or the housing of the blower unit may be designed to generate an air stream that can be used to cool the heat-conducting plates, control unit, motor and/or batteries (cells) and to dissipate heat from these components.

In addition, provisions are made according to the present invention for the protective circuits for monitoring individual cells or a group of cells to be combined with the above excess-current cutoff in order to further increase safety. The protective circuits are preferably designed for monitoring individual cells or a group of cells by thermal cutoffs, as a result of which cells on which an excessive temperature develops are uncoupled or electrically switched off. According to the present invention, individual cells or groups of cells can be protected by respective series connections of a thermal cutoff and an excess-current cutoff. This has the advantage that individual cells or groups of cells can be fully separated or removed from the power supply circuit when an excessive temperature and/or an excessive current appears on the cell or cells in question. A combination of thermal cutoffs and excess-current cutoffs consequently brings about an electrical insulation of the defective cell(s) in case of a possible short circuit, but the short circuit of one or more cells leaves the other cells intact. Besides the separate protection of individual cells, a main protection against high temperatures and/or excessively high currents can be provided, in addition or as an alternative, so that the entire battery pack is switched off in case of a defect.

It is, further, preferred that the individual cells including their protective circuit are installed in a housing and cast in a suitable casting compound such that spark formation is effectively prevented in circuit parts between, for example, individual cells and the corresponding excess-current cutoffs. Further, spark formation between the battery pack and the protective circuit thereof and other components of the blower unit is prevented by this casting compound. Besides the electrically insulating properties, the casting compound possesses good heat conduction properties to make it possible to dissipate excess heat to the environment and/or to other components of the blower unit. As a consequence, the casting ensures that the thermal energy release in case of defect is distributed over a larger thermal capacity, as a result of which the surface temperature can be maintained with certainty below the self-ignition temperature of the ambient flammable gases and dusts.

The present invention will be described below on the basis of an exemplary embodiment with reference to the figures. The present invention shall be explained in more detail on the basis of the following figures and exemplary embodiments, without the present invention being limited to these. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1B:
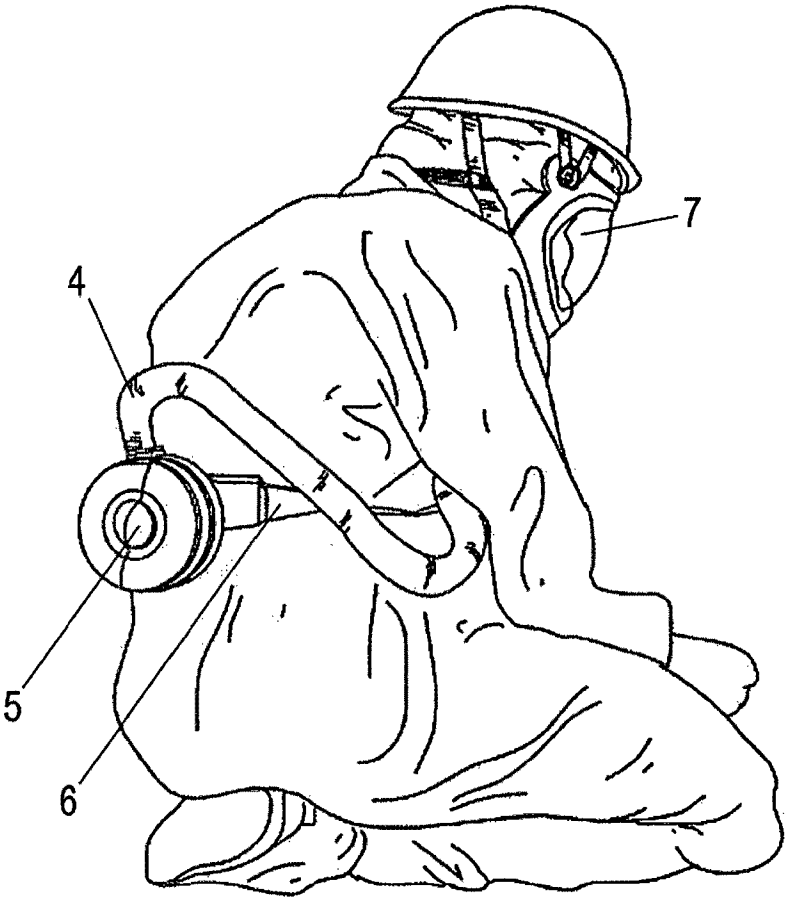
FIG. 1*b* is a view showing an exemplary embodiment of a blower filter system according to the present invention, which is carried on the user's body.
Figure 1A:
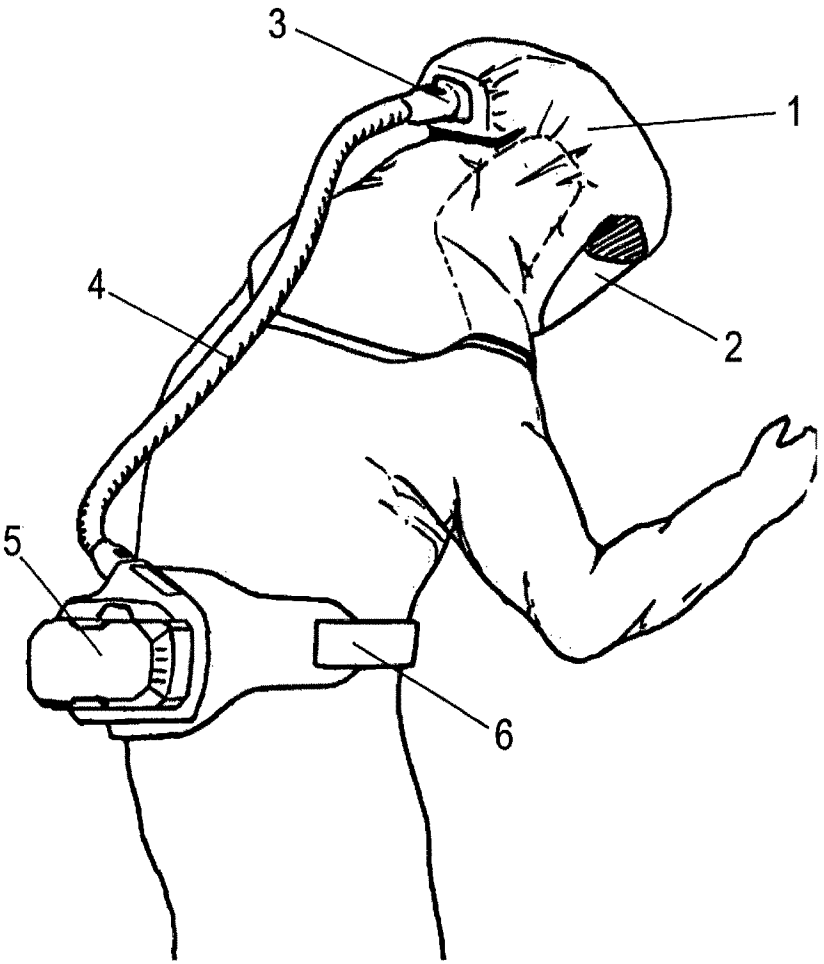
FIG. 1*a* is a view showing an exemplary embodiment of a blower filter system according to the present invention, which is carried on the user's body.

With reference to FIGS. 1*a* and 1*b*, an exemplary embodiment of the blower filter system according to the present invention will be described below. It can be seen in FIG. 1*a* that the user wears a respirator hood 1, which extends over the entire head of the user and is in contact with the user's protective clothing in the area of the back and the chest of the user. As an alternative, the hood may be integrated with the protective clothing (CPS=Chemical Protection Suit). The hood 1 is provided with an eye-protecting lens 2 at the level of the face or the eyes of the user. A port 3 for connecting a breathing tube 4, which is connected at its other end with a blower filter system 5, is preferably provided on the rear side of the protective hood 1. The blower filter system 5 is preferably carried on the user's back by means of a special belt 6 in order to offer the greatest possible freedom of movement to the user.

As is shown in FIG. 1*b*, the user wears a breathing mask 7 in the form of a face mask. The face mask has an eye-protecting lens and a port (not shown) for connecting a breathing tube 4. This breathing tube is connected with the blower filter system 5, which is likewise carried by means of a belt 6 on the user's back.

The blower filter systems 5 shown in FIGS. 1*a* and 1*b* have different shapes, but contain essentially the same components in order to bring about the drawing in of the contaminated air by means of a blower unit and sending the air through a filter, as a result of which the air is sent via the breathing tube 4 to the protective hood 1 or to the gas mask 7. Both blower filter systems 5 contain a blower impeller driven by a motor, a spiral housing as well as a filter, which is provided downstream (on the suction side) in the direction of flow and which is preferably coupled detachably and replaceably with the housing of the blower filter system. The housing of the blower filter system encloses at least the motor, blower impeller and electric circuits. The above-described battery pack may likewise be contained in the housing, but it is preferably arranged detachably on the outer side of the housing and is electrically coupled with the blower unit. The battery pack is preferably provided on the rear side of the blower unit. The battery pack is coupled via conventional mechanisms. As was mentioned in the introduction, the electronic components of the blower unit and those of the battery pack are enclosed by a casting compound essentially completely, so that possible excessive current/voltage conditions within this electronic unit cannot trigger any ignition of the potentially explosive environment. Spark ignition due to potential current/voltage conditions outside the ignition limit curves is consequently effectively prevented by the casting compound. The only accessible conductors are consequently located in the contact area between the blower unit and the battery pack, and this area remains critical concerning a potential spark ignition. This object is accomplished as described in more detail below.

To charge the battery pack, the latter is removed from the blower unit and charged via a suitable charger. As an alternative, the charger may, however, also be connected to the battery pack without the latter having to be separated from the blower unit.

The blower unit usually has a maximum power consumption of about 12 W. The blower unit assumes the central functions of the system and comprises the necessary electronic system for controlling and monitoring the system, besides the blower device (i.e., motor and blower impeller).

It is generally preferred that the volume flow be maintained at a constant level by means of an integrated regulating device. The electronic system detects for this the speed of the motor or blower impeller by means of suitable sensors and the power consumption of the motor.

Even though not shown in FIGS. 1*a* and 1*b*, light-emitting diodes are provided on an operating surface of the blower unit in order to display the status of the system to the user. In addition, buttons or slide controls are provided on the control surface in order to set, for example, the volume flow and in order to switch the blower unit on and off.

Further, the blower unit may be provided with a Bluetooth interface or with another suitable interface in order to communicate with other devices. Finally, the blower unit may contain devices to generate alarms or warning messages visually, acoustically and/or in a tactile manner (e.g., by vibrations). For example, a piezo buzzer or a vibration motor may be provided herefor.

The sensors, control elements (user interface), blower motor and battery pack must be designed to guarantee the explosion protection. For example, the sensors have their currents limited by resistors, and the blower motor is preferably designed as an electrically commuted synchronous motor (brushless DC motor), which is connected in delta connection and in which the inductance of the motor coils between two terminals of the motor circuit preferably equals at most 700 H.

Figure 2:
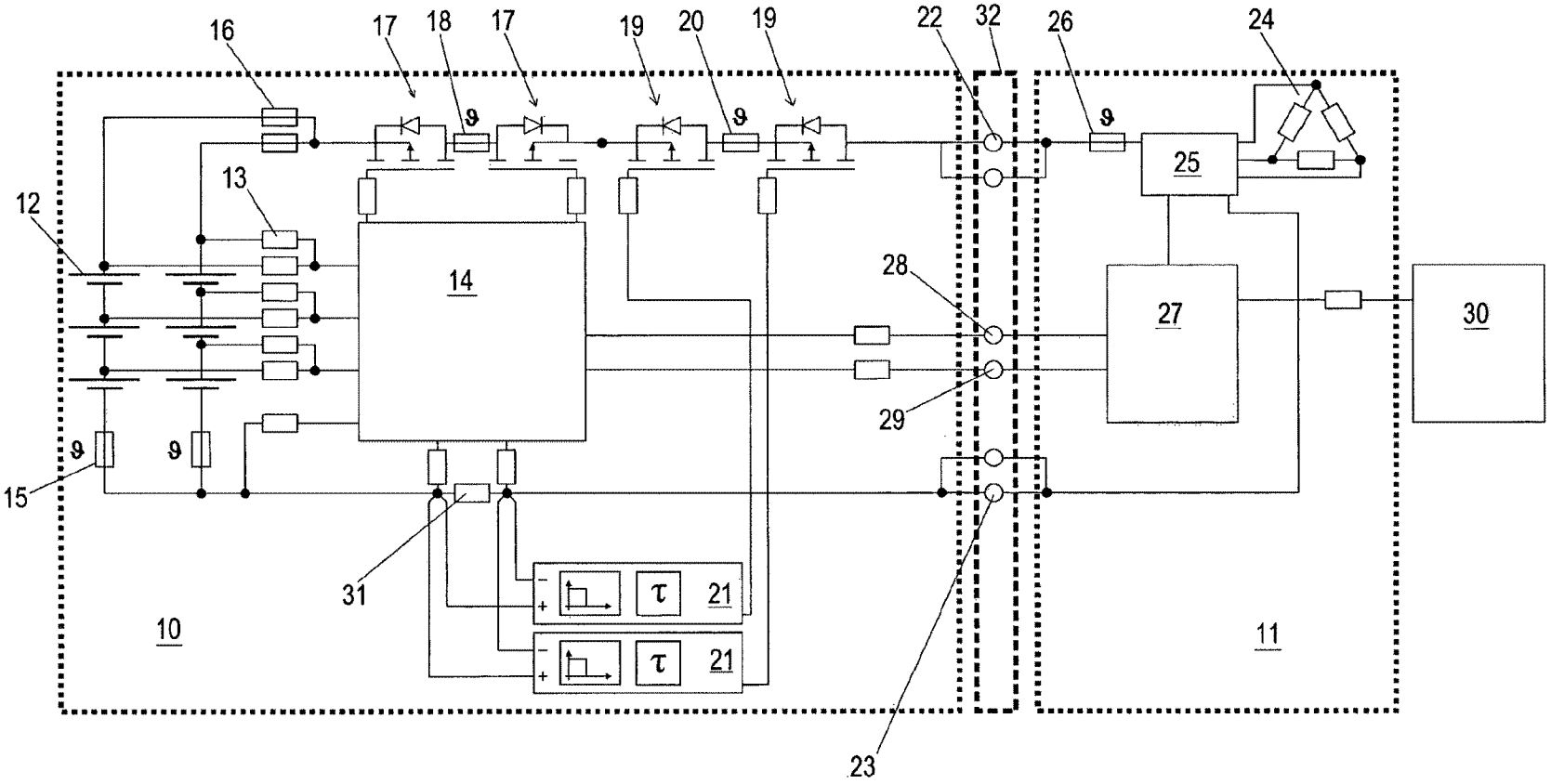
FIG. 2 is a first exemplary embodiment of a circuit diagram of the blower filter system according to the present invention.

FIG. 2 shows the circuit diagram of the blower filter system being claimed according to the present invention. The diagram in FIG. 2 shows a first concept, which is characterized essentially by its mechanical robustness. For example, redundant (i.e., dual) contacts are provided for the energy transmission between the battery pack and the blower unit, as a result of which the breaking of the contacts in case of failure of one contact is prevented. If a defect develops in one of the dual contacts, as a result of which an arc could possibly develop, this arc is prevented by the second (intact) contact.

To prevent the glow ignition of conductive dusts, the output of the blower unit is limited to about 10 W. Further, the surface temperatures of the blower unit and of the battery pack must be below the glow ignition temperature. The response time of the excess-current cutoff is made relatively long (e.g., about 300 msec) for this in case of the embodiment according to FIG. 2.

As can be seen in FIG. 2, the blower filter system comprises a battery pack 10 and a blower unit 11. The battery pack 10 has a plurality of cells 12, whose plus contacts are connected each to a protective circuit 14 via resistors 13. The voltages of the individual cells can be compared with one another in this manner in order to bring about a so-called "cell balancing." By measuring the cell voltages, protection against excessive discharge and deep discharge can, moreover, be achieved by means of the protective circuit 14 in the known manner. Six cells 12, which are embodied as a parallel circuit of two lines with three cells each, are provided in the embodiment being shown. However, other embodiments are possible as well.

Further, thermal cutoffs 15, which have good thermal coupling with the cells, are provided at the minus contacts of the cells 12, and excess-current cutoffs 16 are provided at the plus contacts of the cells 12 in order to bring about immediate cutting off or uncoupling of the cells in case of overheating or when excessively strong battery currents develop. The cutoffs 15 and 16 are preferably redundant (i.e., one excess-current cutoff and one thermal cutoff each for each line) and may also be connected with the lines in another configuration.

Power circuit breakers 17, whose gates can be switched by the protective circuit 14, are provided between the excess-current cutoffs 16 and the plus contacts 22 of the battery pack. A thermal cutoff 18, which responds when a temperature limit is exceeded by one of the circuit breakers 17, is connected between the circuit breakers 17. The circuit breakers 17 are arranged in series (namely, as charge FET and discharge FET) in order to guarantee reliable cutting off. Further power circuit breakers 19, whose gates are connected by excess-current cutoff devices 21 and between which a thermal cutoff 20 is provided, are provided in series with the power circuit breakers 17. The power circuit breakers 19 are likewise present as dual circuit breakers, so that the circuit breakers 19 are effective even in case of failure of one of the circuit breakers connected in series (e.g., due to an inner short circuit, by which cutting off is prevented). The thermal cutoff 20 has the same function as the thermal cutoff 18. As an alternative, a fuse may also be used instead of the excess-current cutoff device, but said fuse is irreversibly destroyed in case of defect and makes the battery pack unusable.

The terminal contacts 22, 23 between the battery pack 10 and the blower unit 11 are designed as dual contacts for the above-mentioned reasons. In addition, the mechanical connection between the battery pack and the blower unit is preferably provided with a safety mechanism in order to prevent an accidental mechanical separation of the battery pack from the blower unit. The removal of the battery pack thus becomes a deliberate action. The mechanical connection may have a seal 32, which is designated by reference number 32 in FIG. 2 and is arranged between the battery pack 10 and the blower unit 11 such as to insulate the contacts 22, 23 against the ambient atmosphere. For example, conductive explosive dusts are essentially prevented from penetrating into the vicinity of these contacts by this seal 32, which is in contact with both the housing of the battery pack and the housing of the blower unit and surrounds the terminal contacts 22, 23 (and preferably also all other contacts), because the space surrounding the contacts is closed by the seal 32 in an essentially dust-proof manner. The mechanical connection between the battery pack 10 and the blower unit 11 is preferably designed such that the seal 32 is compressed when the mechanical connection is locked and is thus pressed in firmly between the two housings. For example, two projections, which mesh with respective openings, which are provided in the housing of the blower unit, are formed on one side of the housing of the battery pack. The battery pack is subsequently snapped in, for example, by a pivoting motion, as a result of which the seal is pressed firmly against the housing of the battery pack and that of the blower unit.

The blower unit 11 contains a blower motor 24, which is controlled by a power stage 25. A thermal cutoff 26, which has good thermal coupling with the power stage 25 in order to prevent the overheating of said power stage in case of defect, is provided between the power stage 25 and the plus contact power stage 25 is controlled by a control unit 27, which is connected with the protective circuit 14 via contacts 28, 29. The control unit 27 is connected, moreover, with a plurality of sensors (not shown), by means of which, for example, the speed of the motor 24 and/or the power consumption of the motor can be detected. In addition, the control unit 27 is connected with an operating unit 30, via which, for example, the motor 24 can be switched on and off as well as the speed of the motor can be varied. In addition, the operating unit may have a plurality of light-emitting diodes or other display devices in order to display, for example, the status of the blower unit, the state of charge of the battery pack and the speed of the motor or the air flow rate. The current to the operating unit 30 is limited by one or more parallel-connected resistors between the operating unit 30 and the control unit 27 such that no spark ignition is possible in case of a defect.

The two independent (redundant) excess-current cutoff devices 21 analyze the voltage drop over a shunt 31 and are connected with the gates of the power circuit breakers 19. As was described above, the power circuit breakers 19 (P-FET) are actuated in case a maximum current flowing through the shunt is exceeded such as to open the circuit breakers. In case the maximum output current of the battery pack is exceeded, each of the devices 21 can therefore bring about the blocking of the corresponding power circuit breakers 19 independently. It is achieved due to the redundancy that reliable cutoff of the battery pack is guaranteed even in case of failure of one of the circuit breakers 19. The devices 21 are designed in this embodiment such as to send a signal to the gate of the circuit breakers 19 after a response time of less than 300 msec. If the current is below the maximum output current of the battery pack for a minimum time, slow, automatic reclosing of the power circuit breakers 19 takes place. In case of a defect, the power circuit breakers 19 may warm up intensely, and the thermal cutoff 20 is therefore provided between the circuit breakers 19. An active temperature monitoring (e.g., an NTC, etc.) may, of course, also be provided instead of the irreversible thermal cutoff 20. A similar temperature monitoring is also provided for the power circuit breakers 17 by providing a thermal cutoff between these circuit breakers. As was explained already, all electronic components of the blower unit 11 including the motor 24 are cast in a casting compound. There is, in principle, only a slight risk that explosive dusts or gases will enter the interior space of the blower unit, because this interior space is screened by the filter. Nevertheless, ignition of explosive dusts or gases, which have nevertheless entered the blower despite the filter, is essentially prevented by the casting compound from occurring.

Figure 3:
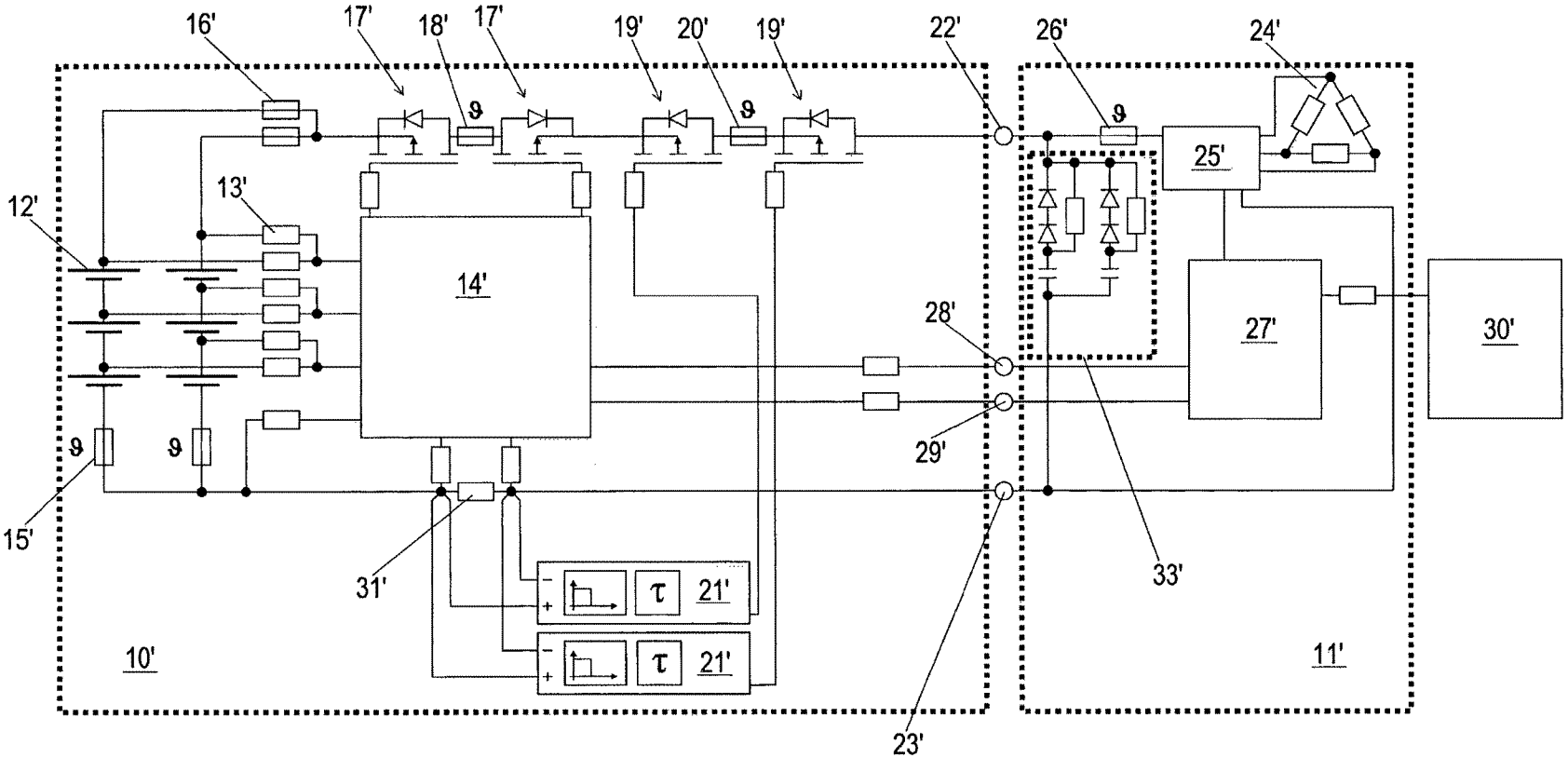
FIG. 3 is a second, slightly modified exemplary embodiment of the diagram from FIG. 2.

FIG. 3 shows a second embodiment of the circuit diagram of the blower filter system as claimed according to the present invention. The diagram in FIG. 3 is very similar to the diagram in FIG. 2 and represents a second concept, which is characterized essentially by its rapid power cutoff (compared to the embodiment according to FIG. 2). Contrary to FIG. 2, only one contact 22', 23' (plus/minus) is provided in the second concept for the energy transmission between the battery pack 10' and the blower unit 11'. This configuration is sufficient, because the protective circuits are designed to guarantee very rapid cutoff. The response time of the current limitation is designed to be relatively short (e.g., about 30 sec and preferably about 15 sec). To prevent the glow ignition of conductive dusts, the output of the blower unit is limited to about 10 W. Further, the surface temperatures of the blower unit and of the battery pack must be below the glow ignition temperature.

As can be seen in FIG. 3, the blower filter system comprises a battery pack 10' and a blower unit 11'. The battery pack 10' has a plurality of cells 12', whose plus contacts are connected each via resistors 13' with a protective circuit 14'. The voltages of the individual cells can be compared with one another in this manner. As this was explained already, protection against excessive discharge and deep discharge can be achieved in the known manner by measuring the cell voltages.

Thermal cutoffs 15', which have good thermal coupling with the cells, are provided at the minus contacts of the cells 12', and excess-current cutoffs 16' are provided at the plus contacts of the cells 12' in order to bring about immediate cutoff or uncoupling of the cells in case of overheating or when excessively high battery currents build up.

Power circuit breakers 17', whose gates can be switched by the protective circuit 14', are provided between the excess-current cutoffs 16' and the plus terminals of the battery pack. A thermal cutoff 18' is connected between the circuit breakers 17'. Further power circuit breakers 19', whose gates are switched by excess-current cutoff devices 21', and between which a thermal cutoff 20' is provided, are provided in series with the power circuit breakers 17'. The thermal cutoffs are each coupled thermally with the power circuit breakers in order to prevent overheating.

The blower unit 11' contains an electric motor 24', which is controlled by a power stage 25'. A thermal cutoff 26', which brings about cutoff in case of excessively high temperature of the power stage, is provided between the power stage 25' and the plus contact 22'. The power stage 25' is controlled by a control unit 27', which is connected with the protective circuit 14' via contacts 28', 29'. The control unit 27' is connected, in addition, with a plurality of sensors (not shown), by means of which, for example, the speed of the motor 24' and/or the power consumption of the motor can be detected. In addition, the control unit 27' is connected with an operating unit 30', which has the same function as the operating unit 27 in FIG. 2.

The two independent excess-current cutoff devices 21' analyze the voltage drop over a shunt 31', as was described with reference to FIG. 2. However, the excess-current cutoff devices 21' have a very short response time, and the power circuit breakers 19' are quick-breaking circuit breakers, so that the circuit breakers 19' are cut off in less than about 30 sec in case the maximum output current of the battery pack is exceeded. By bringing about rapid power cutoff and high speed of circuit breaking of about 30 sec and preferably about 15 sec, the introduction of power into a potential spark can be limited in case of an unacceptable load situation.

In addition, a compensating circuit 33' is provided in the blower unit 11' between the terminals 22' and 23' in order to prevent a potential jump on the side of the blower unit in case of opening (i.e., removal of the battery pack 10' or in case of failure of contacting of the contacts 22', 23'). The compensating circuit 33' comprises two lines extending in parallel, which have each a capacitor and a parallel circuit, which is connected in series thereto and comprises a resistor, on the one hand, and, on the other hand, a series connection of two recovery diodes. It is achieved due to the capacitors connected in series with the recovery diodes that at the moment at which the circuit is broken, the voltage on the contacts 22', 23' is approximately equal to the output voltage of the battery pack. Slow charging of the capacitors is achieved upon renewed contacting due to the resistors connected in parallel to the diodes. When the contacts 22' and 23' are opened again (or when a defect occurs on one of the contacts), a self-induction voltage is generated by the inductance of the coils of the motor 24' at the contacts 22', 23', but this self-induction voltage is immediately reduced by the discharge of the capacitors of the compensating circuit, so that the development of sparks, by which inflammation of the explosive environment could be brought about otherwise, is effectively prevented. As can be seen in FIG. 3, the circuit is designed as a dual circuit, as a result of which the compensating circuit 33' is effective even in case of failure of an individual capacitor or of a recovery diode.

While specific embodiments of the invention have been shown and described in detail to illustrate the application of the principles of the invention, it will be understood that the invention may be embodied otherwise without departing from such principles.

The invention claimed is:

1. A blower filter system comprising:

a blower unit comprising an electric motor for driving a blower impeller, a control unit for controlling the electric motor and blower unit contacts; and a battery pack comprising a plurality of secondary cells with energy density and battery pack contacts for connection with the blower unit, wherein:

the blower unit is detachably coupled with the battery pack;

the battery pack is electrically connected with the blower unit via at least the blower unit contacts and the battery pack contacts;

the battery pack is provided with protective circuits;

the protective circuits comprise electronic components, which are designed to cut off electrically at least one of the plurality of secondary cells of the battery pack when excessively high currents build up and/or when excessively high temperatures build up;

the electronic components comprise a shunt connected to the plurality of secondary cells, a first excess-current cutoff device, a second excess-current cutoff device, a first power circuit breaker and a second power circuit breaker;

the first excess-current cutoff device is connected to the first power circuit breaker and the second excess-current cutoff device is connected to the second power circuit breaker;

the first excess-current cutoff device is arranged on one side of the shunt and the second excess-current cutoff device is arranged on another side of the shunt;

the first power circuit breaker is configured to switch from a first power circuit breaker closed state to a first power circuit breaker open state and the second power circuit breaker is configured to switch from a second power circuit breaker closed state to a second power circuit breaker open state when current flowing through the shunt is greater than a predetermined maximum current such that the at least one of the plurality of secondary cells of the battery pack is electrically shut off; and the battery pack and the blower unit are cast at least partially in a casting compound.

2. A blower filter system comprising:

a blower unit comprising an electric motor for driving a blower impeller, a control unit for controlling the electric motor and blower unit contacts; and a battery pack comprising a plurality of secondary cells with energy density and battery pack contacts for connection with the blower unit, wherein:

the blower unit is detachably coupled with the battery pack;

the battery pack is electrically connected with the blower unit via at least the blower unit contacts and the battery pack contacts;

the battery pack is provided with protective circuits;

the protective circuits comprise electronic components, which are designed to cut off electrically at least one of the plurality of secondary cells of the battery pack when excessively high currents build up and/or when excessively high temperatures build up;

the electronic components comprise a shunt connected to the plurality of secondary cells, a first excess-current cutoff device, a second excess-current cutoff device, a first power circuit breaker and a second power circuit breaker;

the first excess-current cutoff device is connected to the first power circuit breaker and the second excess-current cutoff device is connected to the second power circuit breaker;

the first excess-current cutoff device is arranged on one side of the shunt and the second excess-current cutoff device is arranged on another side of the shunt;

the first power circuit breaker is configured to switch from a first power circuit breaker closed state to a first power circuit breaker open state based on a signal from the first excess-current cutoff device and the second power circuit breaker is configured to switch from a second power circuit breaker closed state to a second power circuit breaker open state based on a signal from the second excess-current cutoff device when current flowing through the shunt is greater than a predetermined maximum current such that the at least one of the plurality of secondary cells of the battery pack is electrically shut off; and the battery pack and the blower unit are cast at least partially in a casting compound.

3. A blower filter system in accordance with claim 2, wherein the protective circuits comprise at least one of a thermal cutoff and a third excess-current cutoff device, which are connected to cut off electrically to at least one of the plurality of secondary cells of the battery pack in case a maximum temperature is exceeded and/or the predetermined maximum current is exceeded.

4. A blower filter system in accordance with claim 3, wherein the thermal cutoff and the third excess-current cutoff device are connected in series.

5. A blower filter system in accordance with claim 2, wherein the first power circuit breaker is configured to switch from the first power circuit breaker open state to the first power circuit breaker closed state and the second power circuit breaker is configured to switch from the second power circuit breaker open state to the second power circuit breaker closed state when the current flowing through the shunt is less than the predetermined maximum current such that each of the secondary cells is electrically connected to the blower unit, the first excess-current cutoff device and the second excess-current cutoff device being configured to analyze a voltage drop across the shunt.

6. A blower filter system in accordance with claim 2, wherein the first power circuit breaker and the second power circuit breaker are opened when a maximum output current of at least one of the plurality of secondary cells is exceeded.

7. A blower filter system in accordance with claim 2, wherein:

the first power circuit breaker is opened when a maximum output current of the battery pack is exceeded; and the second power circuit breaker is opened when a maximum output current of at least one of the plurality of secondary cells is exceeded, the first power circuit breaker and the second power circuit breaker being connected in series.

8. A blower filter system in accordance with claim 5, wherein a thermal cutoff is connected and arranged in series with one or more of the first power circuit breaker and the second power circuit breaker to be opened when a temperature limit of the one or more of the first power circuit breaker and the second power circuit breaker is exceeded.

9. A blower filter system in accordance with claim 2, wherein the secondary cells comprise at least one of lithium ion cells (Li ion) and lithium-manganese cells (LiMn) and lithium-nickel-cobalt-aluminum-based cells ($LiNiCoAlO_2$) with carbon as a stabilizer.

10. A blower filter system in accordance with claim 2, wherein the casting compound is heat-conducting and electrically insulating.

11. A blower filter system in accordance with claim 2, wherein the secondary cells and the protective circuits are cast in the casting compound.

12. A blower filter system in accordance with claim 2, further comprising a compensating circuit preventing a potential jump on the contacts, the compensating circuit being provided in the blower unit between the contacts.

13. A blower filter system in accordance with claim 12, wherein the compensating circuit comprises at least one capacitor and a parallel circuit, which is connected in series thereto and comprises a resistor and a series connection of two recovery diodes.

14. A blower filter system in accordance with claim 6, wherein a thermal cutoff connected and arranged in series with one or more of the first power circuit breaker and the second power circuit breaker to be opened when a temperature limit of the one or more of the first power circuit breaker and the second power circuit breaker is exceeded.

15. A blower filter system comprising:

a blower unit comprising:

a blower impeller electric motor;

a control unit controlling the electric motor; and blower unit contacts;

a battery pack detachably coupleable with the blower unit, the battery pack comprising:

a plurality of energy density battery cells;

battery pack contacts for connection with the blower unit contacts to provide an electrical connection of the battery pack with the blower unit via the battery pack contacts and the blower unit contacts; and protective circuits comprising electronic components to electrically cut off at least one of the plurality of the energy density battery cells upon at least one of a build up of current and a build up of temperature, the electronic components comprising a shunt connected to the plurality of energy density battery cells, a first excess-current cutoff device, a second excess-current cutoff device, a first power circuit breaker and a second power circuit breaker, the first excess-current cutoff device being connected to the first power circuit breaker, the second excess-current cutoff device being connected to the second power circuit breaker, the first excess-current cutoff device being arranged on one side of the shunt, the second excess-current cutoff device being arranged on another side of the shunt, the first power circuit breaker being configured to switch from a first power circuit breaker closed state to a first power circuit breaker open state based on a signal from the first excess-current cutoff device and the second power circuit breaker being configured to switch from a second power circuit breaker closed state to a second power circuit breaker open state based on a signal from the second excess-current cutoff device when a current flowing through the shunt is greater than a predetermined maximum current such that the at least one of the plurality of the energy density battery cells is electrically disconnected from the blower unit; and casting compound, the battery pack and the blower unit being cast at least partially in the casting compound.

16. A blower filter system in accordance with claim 15, wherein the protective circuits comprise at least one of a thermal cutoff and a third excess-current cutoff device, which are connected to cut off electrically to at least one of the plurality of battery cells of the battery pack in case a maximum temperature is exceeded and/or the predetermined maximum current is exceeded.

17. A blower filter system in accordance with claim 16, wherein the thermal cutoff and the third excess-current cutoff device are connected in series.

18. A blower filter system in accordance with claim 15, wherein the first power circuit breaker is configured to switch from the first power circuit breaker open state to the first power circuit breaker closed state and the second power circuit breaker is configured to switch from the second power circuit breaker open state to the second power circuit breaker closed state when the current flowing through the shunt is less than the predetermined maximum current such that each of the plurality of energy density battery cells is electrically connected to the blower unit, the first excess-current cutoff device and the second excess-current cutoff device being configured to analyze a voltage drop across the shunt.

19. A blower filter system in accordance with claim 15, wherein the first power circuit breaker and the second power circuit breaker are opened when a maximum output current of at least one of the plurality of battery cells is exceeded.

20. A blower filter system in accordance with claim 15, wherein the blower unit further comprises a compensating circuit preventing a potential jump between the contacts, wherein the compensating circuit comprises at least one capacitor and a parallel circuit, which is connected in series thereto and comprises a resistor and a series connection of two recovery diodes.

* * * * *